US008528380B2

(12) United States Patent
Kuwayama et al.

(10) Patent No.: US 8,528,380 B2
(45) Date of Patent: Sep. 10, 2013

(54) BENDING APPARATUS

(75) Inventors: Shinjiro Kuwayama, Osaka (JP); Atsushi Tomizawa, Minou (JP); Saburo Inoue, Tama (JP)

(73) Assignees: Sumitomo Pipe & Tube Co., Ltd., Ibaraki (JP); Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/300,714

(22) Filed: Nov. 21, 2011

(65) Prior Publication Data

US 2012/0085138 A1 Apr. 12, 2012

Related U.S. Application Data

(63) Continuation of application No. PCT/JP2010/058300, filed on May 17, 2010.

(30) Foreign Application Priority Data

May 19, 2009 (JP) ..... 2009-120844

(51) Int. Cl.
*B21D 9/00* (2006.01)

(52) U.S. Cl.
USPC ..... 72/369; 72/459; 72/364; 72/342.6; 414/738; 269/56; 901/31

(58) Field of Classification Search
USPC ..... 72/422, 364, 342.6, 202, 404, 447, 72/369, 459; 901/31, 39; 279/19.4, 20.1, 279/43.4, 43.6, 46.9, 120; 76/34; 23/273; 269/56
See application file for complete search history.

(56) References Cited

U.S. PATENT DOCUMENTS 2,815,959 A * 12/1957 Vandenberg ..... 279/123
3,600,787 A * 8/1971 Lindsay ..... 29/25.41
3,642,243 A * 2/1972 Smith ..... 254/100

(Continued)

FOREIGN PATENT DOCUMENTS

| | | |
|---|---|---|
| JP | 2000-126821 | 5/2000 |
| JP | 2009-50903 | 3/2009 |
| WO | 2006/093006 | 9/2006 |
| WO | 2008/123506 | 10/2008 |

OTHER PUBLICATIONS

Jidosha Gijustsu, Journal of Society of Automotive Engineers of Japan, vol. 57, No. 6, 2003, pp. 23-28.

*Primary Examiner* — Dana Ross
*Assistant Examiner* — Homer Boyer
(74) *Attorney, Agent, or Firm* — Clark & Brody

(57) ABSTRACT

A bending apparatus which manufactures a bent metal member with high productivity and excellent dimensional has a first support mechanism, which supports a steel tube while feeding it, a heating mechanism, which heats all or a portion of the steel tube, a cooling mechanism, which forms a high temperature portion in part of the steel tube by cooling a portion of the heater steel tube, a second support mechanism, which imparts a bending moment to the high temperature portion and bends the steel tube to a desired shape by moving two-dimensionally or three-dimensionally while supporting at least a portion of the steel tube, and a deformation preventing mechanism, which prevents deformation of the steel tube. At least one of the second support mechanism and the deformation preventing mechanism has a chuck which has a tubular member with a circular, polygonal, or special transverse cross section for gripping the steel tube.

34 Claims, 9 Drawing Sheets

(56) References Cited

U.S. PATENT DOCUMENTS

| | | | | | |
|---|---|---|---|---|---|
| 4,062,216 | A | * | 12/1977 | Hanamoto et al. | 72/128 |
| 4,621,853 | A | * | 11/1986 | Fink | 294/203 |
| 4,906,011 | A | * | 3/1990 | Hiyamizu et al. | 279/3 |
| 4,962,917 | A | * | 10/1990 | Tamura et al. | 269/56 |
| 5,221,099 | A | * | 6/1993 | Jansch | 279/151 |
| 5,324,050 | A | * | 6/1994 | Kanaan | 279/46.7 |
| 5,335,529 | A | * | 8/1994 | Crowdus et al. | 72/404 |
| 5,775,755 | A | * | 7/1998 | Covert et al. | 294/196 |
| 6,227,549 | B1 | * | 5/2001 | Michel | 279/60 |
| 6,777,903 | B1 | * | 8/2004 | Ostwald | 318/568.21 |
| 6,805,642 | B2 | * | 10/2004 | Meyer | 473/320 |
| 7,134,310 | B2 | * | 11/2006 | Hu | 72/307 |
| 7,845,651 | B2 | * | 12/2010 | Yaksich | 279/62 |
| 2003/0004017 | A1 | * | 1/2003 | Brown | 473/422 |
| 2011/0211938 | A1 | * | 9/2011 | Eakins et al. | 414/738 |

* cited by examiner

BENDING APPARATUS

TECHNICAL FIELD

This invention relates to a bending apparatus. Specifically, the present invention relates to a bending apparatus for manufacturing a bent member by applying two-dimensional or three-dimensional bending to an elongated metal material having a closed cross section.

BACKGROUND ART

Strength members, reinforcing members, and structural members which are made of metal and have a bent shape are used in automobiles, various types of machines, and the like. These bent members need to have a high strength, a light weight, and a small size. In the past, this type of bent member has been manufactured by methods such as welding of press formed members, punching of thick plates, and forging. However, it is difficult to further reduce the weight and size of bent members manufactured by these methods.

Non-Patent Document 1, for example, discloses the manufacture of this type of bent member by so-called tube hydroforming Page 28 of Non-Patent Document 1 discloses that there are various challenges in the tube hydroforming technique, such as the development of materials for use in the method and increasing the degree of freedom of shapes which can be formed, and that further technological development is necessary.

In Patent Document 1, the present applicant disclosed a bending apparatus. FIG. 13 is an explanatory view schematically showing that bending apparatus 0.

As shown in FIG. 13, the bending apparatus performs the following operations on a steel tube 1 which is a material to be processed and which is supported by a support means 2 so as to be movable in its axial direction while being fed from an upstream side towards a downstream side by a feed device 3 such as a ball screw:

(a) rapidly heating a portion of the steel tube 1 with a high frequency heating coil 5 located downstream of the support means 2 to a temperature range in which quench-hardening is possible, (b) rapidly cooling the steel tube 1 with a water cooling device 6 disposed downstream of the high frequency heating coil 5, and (c) imparting a bending moment to the heated portion of the steel tube 1 to perform bending two-dimensionally or three-dimensionally by varying the position of a movable roller die 4 having at least one set of roll pairs 4*a* which can support the steel tube 1 while feeding it.

As a result, a bent member 8 is manufactured with high operating efficiency while guaranteeing an adequate bending accuracy.

LIST OF PRIOR ART DOCUMENTS

Patent Document 1: WO 2006/093006

Non-Patent Document 1: Jidosha Gijustsu (Journal of Society of Automotive Engineers of Japan), Vol. 57, No. 6, 2003, pages 23-28

SUMMARY OF THE INVENTION

If the feed device 3 does not suitably support the front end or rear end of a steel tube 1, the bending apparatus 0 has the following problems (a)-(e).

(a) The bent member 8 does not have a sufficient bending accuracy.

(b) A large force becomes necessary at the time of bending. The yield of the bent member 8 decreases. Furthermore, the interior of the steel tube 1 which is exposed to the atmosphere at a high temperature oxidizes, and the quality of the bent member 8 decreases.

(c) Cooling water which is sprayed at the steel tube 1 from the water cooling device 6 enters inside the steel tube 1 and interferes with heating of the steel tube 1 by the high frequency heating coil 5, so the dimensional accuracy of the bent member 8 decreases.

(d) The steel tube 1 is impeded from successively passing through the support means 2, the high frequency heating coil 5, and the water cooling device 6, and bending of the steel tube 1 can no longer take place.

(e) The portions which hold the steel tube 1 are heated by the high frequency coil 5 to a temperature at which deformation is possible, and as a result, the dimensional accuracy of the bent member 8 decreases.

The object of the present invention is to eliminate problems (a)-(e) of bending apparatus 0 and to provide a bending apparatus for manufacturing an elongated bent metal member having a closed cross section with higher productivity and superior dimensional accuracy compared to bending apparatus 0.

The present invention is based on the finding that above-described problems (a)-(e) can be solved by (i) providing the feed device 3 of the bending apparatus 0 or a malformation preventing device or the like disposed downstream of the moveable roller die 4 in the feed direction of a steel tube 1 with a cylindrical chuck which is disposed on the interior or the exterior of the steel tube 1 to grip the steel tube 1, and (ii) optimizing the shape, structure, and function of this chuck.

The present invention is a bending apparatus characterized by having the below-described first support mechanism, heating mechanism, cooling mechanism, second support mechanism, and malformation preventing mechanism, wherein at least one of the second support mechanism and the malformation preventing mechanism has the below-described chuck:

First Support Mechanism: It is disposed at a first position and supports a hollow metal material while feeding it.

Heating Mechanism: It is disposed at a second position downstream of the first position in the feed direction of the metal material and heats all or a portion of the metal material being fed.

Cooling Mechanism: It is disposed at a third position downstream of the second position in the feed direction of the metal material, and it cools the portion of the metal material being fed which was heated by the heating mechanism to form a high temperature portion in part of the metal material.

Second Support Mechanism: It is disposed at a fourth position downstream of the third position in the feed direction of the metal material and it moves two-dimensionally or three-dimensionally while supporting at least one location of the metal material being fed, thereby imparting a bending moment to the high temperature portion of the metal material so as to bend the metal material into a desired shape.

Malformation Preventing Mechanism: It is disposed at a fifth position downstream of the fourth position in the feed direction of the metal material, and it prevents malformation of the metal material being fed.

Chuck: It comprises a tubular member having a circular, polygonal, or shaped transverse cross-sectional shape and grips the metal material.

In the present invention, it is preferable that (I) there be a feed mechanism which feeds the metal material in its lengthwise direction and which preferably has the above-described chuck, or (II) the first support mechanism feed the metal material in its lengthwise direction.

In the present invention, the chuck is preferably inserted inside the metal material and contacts the inner surface of the metal material, and the outer dimensions of this tubular member can preferably be enlarged.

In the present invention, the chuck is preferably installed on the exterior of the metal material and contacts the outer surface of the metal material, and the inner dimensions of the tubular member can preferably be contracted.

In the present invention, the chuck can preferably prevent cooling water from entering inside the metal material by sealing the interior of the metal material or applying a positive pressure to the interior of the metal material. In the present invention, it is still more preferable that oxidation of the interior of the metal material can be prevented by sealing an inert gas or the like inside the metal material.

In the present invention, the tubular member of the chuck is preferably installed so that its longitudinal axis roughly coincides with the longitudinal axis of the metal material, and it preferably has outer dimensions which roughly correspond to the outer dimensions of the metal material.

In the present invention, the tubular member preferably has chuck claws and an operating bar which are made of a high hardness material.

In the present invention, the tubular member is preferably constituted by a plurality of components which are divided in the circumferential direction and by an insulating member disposed between adjoining components.

In the present invention, the tubular member is preferably non-magnetic. Specifically, the tubular member is preferably made of a ceramic, an austenitic stainless steel such as SUS 304, or a nickel alloy, for example.

In the present invention, the tubular member preferably has a laminated structure. A laminated structure means a structure formed by stacking thin metal sheets on one another. Due to the laminated structure, it becomes difficult for induced currents caused by high frequencies to flow inside the tubular member, and as a result, it becomes difficult for the chuck to undergo induction heating.

The present invention eliminates above-described problems (a)-(e). Therefore, according to the present invention, it is possible to reliably manufacture a strength member, a reinforcing member, or a structural member which is made of metal and which has a shape which is bent two-dimensionally or three-dimensionally with high operating efficiency while guaranteeing sufficient dimensional accuracy.

BRIEF EXPLANATION OF THE DRAWINGS

FIG. 5(*c*) is an explanatory view showing various chucks 35-43.

EXPLANATION OF SYMBOLS

0: bending apparatus disclosed in Patent Document 1,

1: steel tube, 2: support means, 3: feed device, 4: movable roller die,

4*a*: roll pair, 5: high-frequency heating coil, 6: water cooling device,

8: bent member,

10: bending apparatus according to the present invention,

11: feed means, 12: first support means, 12*a*, 12*a*: roll pairs,

13: heating means, 13*a*: heating coil, 14: cooling means,

14*a*, 14*b*: nozzles for spraying cooling water,

15: second support means, 16: malformation preventing means,

17: steel tube, 17*a*: end portion, 18: first industrial robot,

19: upper arm, 20: front arm, 20*a*: wrist, 21: controller,

22: input unit, 23: pallet, 24: end effector, 25: movable roller die,

25*a*, 25*b*: roll pairs, 26: second industrial robot, 26*a*: gripper,

27: high frequency coil support robot: 28: third industrial robot,

29: end effector, 30-44, 46, 48, 49, 57, 58: chucks,

45: cylinder, 47: support guide, 50: body, 51: shaft, 52: operating bar,

53: chuck claws, 54: conical bar, 55: segments, 56: elastic claws,

57*a*, 57*b*: components, 59: insulating member, 60: chuck, 61: sleeve,

62: slit, 63: sealing ring, 70, 70-1: chucks, 71: high pressure liquid,

72: flow passage, 73: sleeve, 74: cylinder

MODES FOR CARRYING OUT THE INVENTION

The present invention will be explained while referring to the attached drawings. In the following explanation, an example will be given of the case in which a hollow metal material having a closed cross section in the present invention is a steel tube 17, but the present invention is not limited to a steel tube, and it can be applied in the same manner to any hollow metal material having a closed cross section (such as a rectangular tube or a tube with a shaped cross section).

Figure 1:
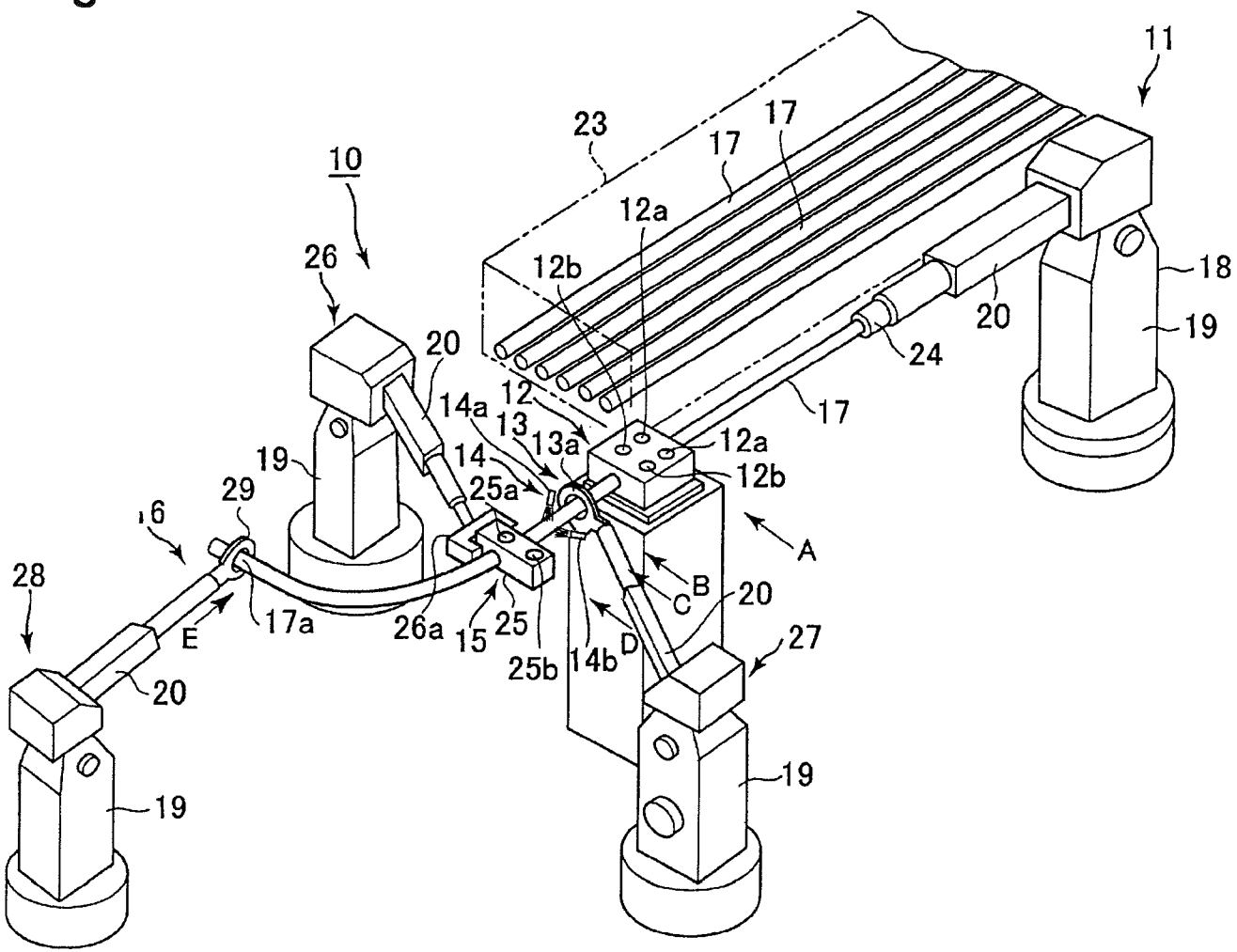
FIG. 1 is a perspective view showing an example of the structure of a bending apparatus according to the present invention.

FIG. 1 is a perspective view showing in simplified and abbreviated form a portion of an example of the structure of a bending apparatus 10 according to the present invention. In FIG. 1, a first industrial robot 18, a heating coil support robot 27, a second industrial robot 26, and a third industrial robot 28 are shown with manipulators and the like illustrated conceptually and in simplified form.

The bending apparatus 10 has a feed mechanism 11, a first support mechanism 12, a heating mechanism 13, a cooling mechanism 14, a second support mechanism 15, and a malformation preventing mechanism 16.

[Feed Mechanism 11]

The feed mechanism 11 feeds a steel tube 17 in its lengthwise direction. The feed mechanism 11 is constituted by a first industrial robot 18.

The first industrial robot 18, the heating coil support robot 27, and the third industrial robot 28 are all the same type of robot as the second industrial robot 26.

Figure 2:
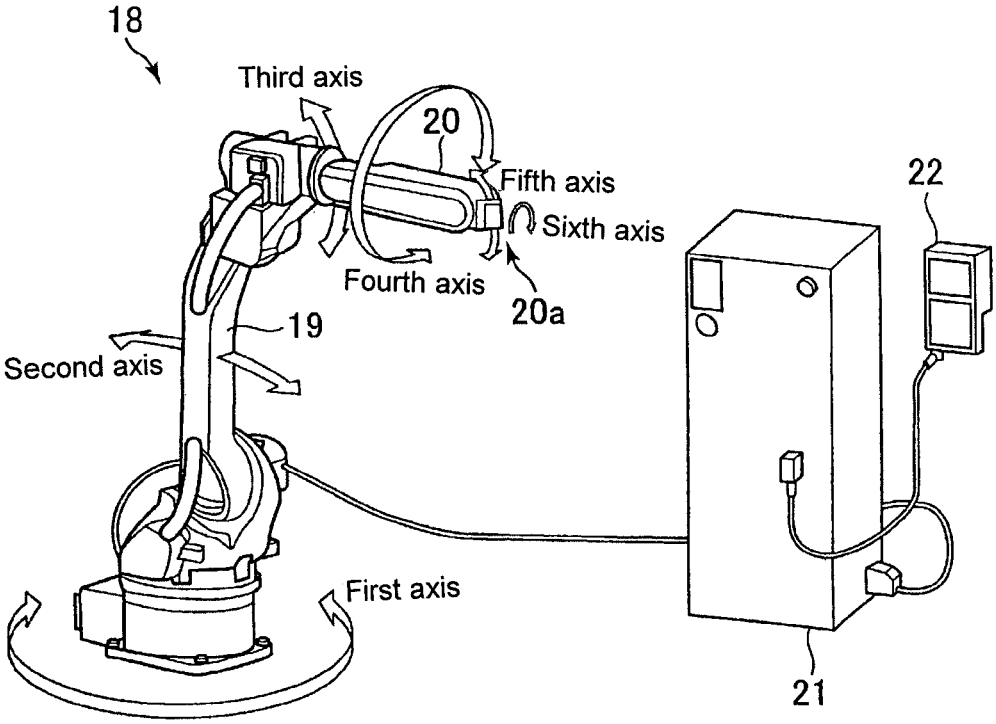
FIG. 2 is an explanatory view showing an example of the structure of a first industrial robot, a second industrial robot, a heating coil support robot, or a third industrial robot.

FIG. 2 is an explanatory view showing an example of the structure of the first industrial robot 18, the second industrial robot 26, the heating coil support robot 27, or the third industrial robot 28.

The first industrial robot 18, the second industrial robot 26, the heating coil support robot 27, and the third industrial robot 28 (referred to below as the robots) are each so-called vertical articulated robots having first through sixth axes.

The first axis allows an upper arm 19 to pivot in a horizontal plane. The second axis allows the upper arm 19 to swing forwards and backwards. The third axis allows a front arm 20 to swing up and down. A fourth axis allows the forearm 20 to rotate. The fifth axis allows a wrist 20*a* to swing up and down. The sixth axis allows the wrist 20*a* to rotate.

In addition to the first through sixth axes, the robots may if necessary have a seventh axis which allows the upper arm 19 to pivot. The first through seventh axes are driven by AC servomotors.

In the same manner as other general purpose industrial robots, each of the robots has a controller 21 which performs overall control of the operation of the first through sixth axes and an input unit 22 for providing instructions for the operation of the first through sixth axes.

An end effector 24 is provided on the end of the wrist 20*a* of the first industrial robot 18. The end effector 24 is used for gripping a steel tube 17 housed in a pallet 23 disposed in the vicinity of the side of the first industrial robot 18 and for passing the gripped steel tube 17 through holes provided in the first support means 12 and the heating means 13.

The end effector 24 is used not only when the feed mechanism 11 is feeding a steel tube 17 but also when a steel tube 17 is directly gripped by the second industrial robot 26 without using the movable roller die 25 as a below-described second support mechanism 15 and when the steel tube 17 is supported by the malformation preventing mechanism 16.

The end effector 24 greatly affects the dimensional accuracy and productivity of a bent member which is manufactured by this bending apparatus 10. The end effector 24 will be explained below in detail.

In the following explanation, an example of an end effector will be given for the case in which a movable roller die 25 is not used as a second support mechanism 15 and a steel tube 17 is directly gripped by the second industrial robot 26. This description applies to the end effector 24 of the feed mechanism 11 and an end effector 29 of the malformation preventing mechanism 16.

Figure 3:
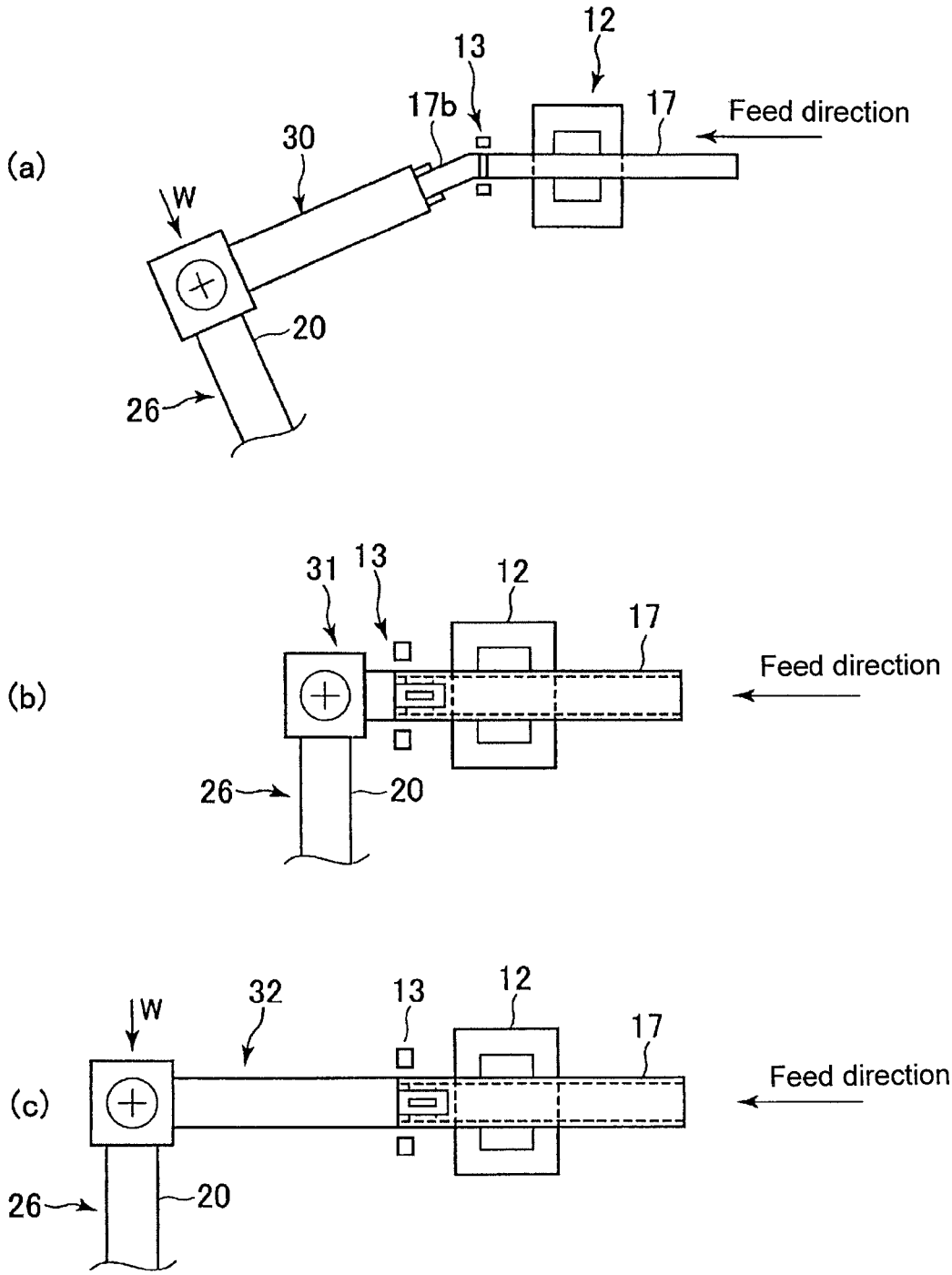
FIG. 3(*a*) is an explanatory view schematically showing an elongated chuck which is used as an end effector when a steel tube is directly gripped by a second industrial robot used as a second support means, FIG. 3(*b*) is an explanatory view schematically showing a short chuck which is used as an end effector when a steel tube is directly gripped by a second industrial robot used as a second support means, and FIG. 3(*c*) is an explanatory view schematically showing an elongated chuck which is used as an end effector when a steel tube is directly gripped by a second industrial robot used as a second support means.

FIG. 3(*a*) is an explanatory view schematically showing an end effector in the form of an elongated chuck 30 for the case in which a steel tube 17 is directly gripped by the second industrial robot 26 without using a movable roller die 25 as a second support mechanism 15, FIG. 3(*b*) is an explanatory view schematically showing an end effector in the form of a short chuck 31 for the case in which a steel tube 17 is directly gripped by the second industrial robot 26 without using a movable roller die 25 as a second support mechanism 15, and FIG. 3(*c*) is an explanatory view schematically showing an end effector in the form of an elongated chuck 32 for the case in which a steel tube 17 is directly gripped by the second industrial robot 26 without using a movable roller die 25 as a second support mechanism 15.

The chucks 30-32 each comprise a tubular member for gripping an end of a steel tube 17.

Chuck 30 is disposed on the exterior of a steel tube 17. Chuck 30 grips an end of a steel tube 17 by contacting the outer surface 17*b* of the steel tube 17. Chuck 30 has a structure such that its inner diameter can be contracted by a below-described suitable mechanism.

Each of chucks 31 and 32 is inserted inside a steel tube 17. Chucks 31 and 32 grip an end of a steel tube 17 by contacting the inner surface of the steel tube 17. Each of chucks 31 and 32 has a structure such that its outer diameter can be expanded by a below-described suitable mechanism.

Each of these chucks 30-32 properly holds an end of a steel tube being fed in its axial direction. Therefore, the bending apparatus 10 can bend a steel tube 17 with a sufficient working accuracy.

Each of chucks 30-32 has a tube end sealing mechanism which contacts a sealing surface formed on the end of a steel tube or an inner surface sealing mechanism which contacts a sealing surface formed on the inner surface of a steel tube. As a result, the chucks 30-32 seal a steel tube 17 by directly contacting the end or the inner surface of the steel tube 17. The chucks 30-32 prevent water from entering inside the steel tube 17, so heating of the steel tube 17 by the high frequency heating coil 13*a* can be properly carried out. Therefore, the bending apparatus 10 can bend a steel tube 17 with sufficient accuracy.

Chuck 30 comprises an elongated tubular member. Therefore, the bending load W is restrained to a small value, and interference between the second industrial robot 26 and equipment in its periphery is prevented even when bending begins from the vicinity of the front end of a steel tube 17.

Chuck 31 comprises a short tubular member. Quench hardening of a steel tube 17 is carried out from the end of the steel tube 17, so the product yield is increased.

Chuck 32 comprises an elongated tubular member, so bending loads W are suppressed to a low value. Interference between the second industrial robot 26 and equipment in its periphery is prevented even when bending starts from the vicinity of the end of a steel tube 17, and quench hardening is carried out from the end of the steel tube 17, thereby increasing the product yield.

Figure 4:
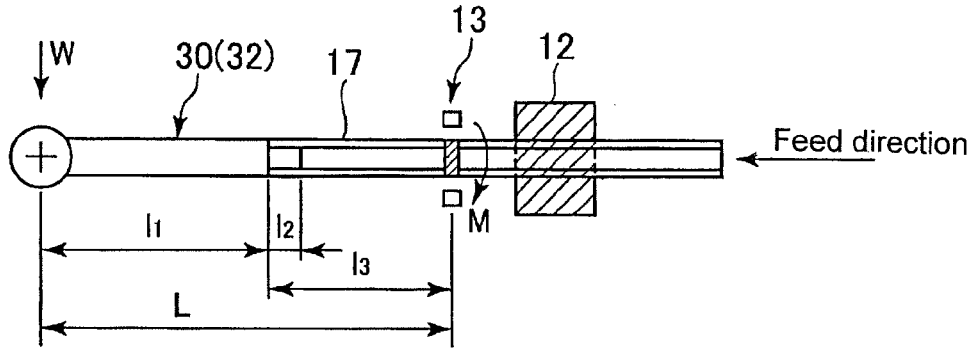
FIG. 4 is an explanatory view showing that an elongated chuck can decrease a bending load.

FIG. 4 is an explanatory view showing that chucks 30 and 32 can reduce the bending load W.

In FIG. 4, symbol W indicates the bending load, symbol M indicates the moments necessary for bending of a steel tube 17, symbol $l_1$ indicates the length of the chuck, symbol $l_2$ indicates the chucking contact length, and symbol $l_3$ indicates the distance from the end of the steel tube 17 to the point where bending begins.

The bending load is defined as $W=M/L=M/(l_1+l_3)$. The longer L is, the smaller W can be. In order to improve the product yield, it is preferable to start bending in the vicinity of an end of a steel tube 17, namely, it is preferable to make $l_3$ small. When there are limits on the allowable load of bending equipment, $l_3$ can be shortened by lengthening $l_1$.

For example, when carrying out bending of a steel tube having an outer diameter of 25 mm and a wall thickness of 1.0 mm with a bending radius of 200 mm, the moment necessary for bending is approximately 36 Nm.

If the allowable bending load is 500 N, then when L=d, W=1440 N>500 N, and when L=2*d*, W=720 N>500 N, so bending cannot be carried out in either case. In contrast, when L=3*d*, W=480 N≦500 N, when L=4*d*, W=360 N≦500 N, and when L=5*d*, W=288 N≦500 N, so bending can be carried out in each case.

For this reason, under the above-described conditions, the relationship is preferably satisfied.

Figure 5:
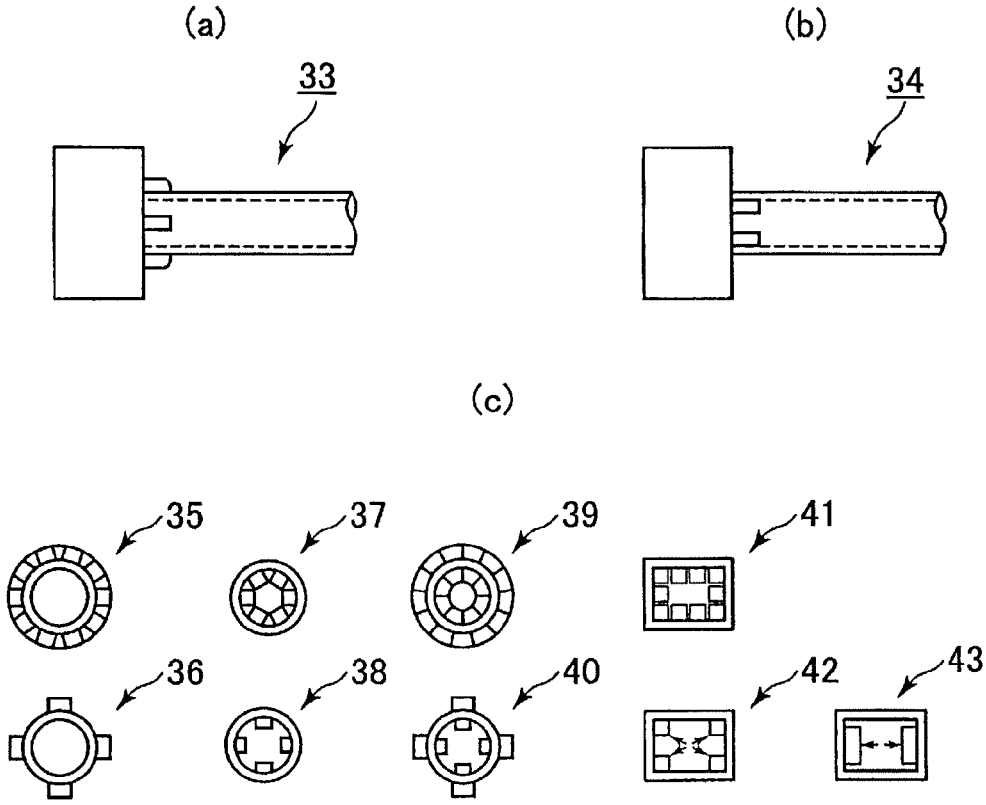
FIG. 5(*a*) is an explanatory view showing a chuck of a type which is disposed on the exterior of a steel tube and which grips the end of the steel tube by contacting the outer surface of the steel tube, and FIG. 5(*b*) is an explanatory view of a chuck of a type which is inserted into the interior of the steel tube and which grips the end of the steel tube by contacting the inner surface of the steel tube.

FIG. 5(*a*) is an explanatory view showing a chuck 33 of a type which is disposed on the exterior of a steel tube and which grips an end of the steel tube by contacting the outer surface of the steel tube, and FIG. 5(*b*) is an explanatory view of a chuck 34 of a type which is inserted inside a steel tube and which grips an end of the steel tube by contacting the inner surface of the steel tube.

Chuck 34 is preferable to chuck 33 since it can be more easily centered with respect to a steel tube and can more easily obtain a gripping force by a tensile force in the circumferential direction of a steel tube.

FIG. 5(*c*) is an explanatory view showing various chucks 35-43.

Chucks 35 and 36 are disposed on the exterior of a steel tube and contact the outer surface of the steel tube.

Chucks 37 and 38 are inserted inside a steel tube and contact the inner surface of the steel tube.

Chucks 39 and 40 are disposed on the exterior of a steel tube and contact the outer surface of the steel tube, and they are also inserted inside the steel tube and contact the inner surface of the steel tube.

Chucks 41-43 are each chucks for rectangular tubes. In order to obtain a sufficient holding force even with a rectangular tube and to grip a rectangular tube with certainty, chucks 41-43 are preferably inserted into a steel tube and contact the inner surface of the steel tube and also contact the inner corners of the rectangular tube.

Each of the above chucks is preferably disposed such that its central axis approximately coincides with the central axis of a steel tube so that the chuck can pass through the first support device 12, the heating device 13, the cooling device 14, and the second support device 15 with certainty.

Figure 6:
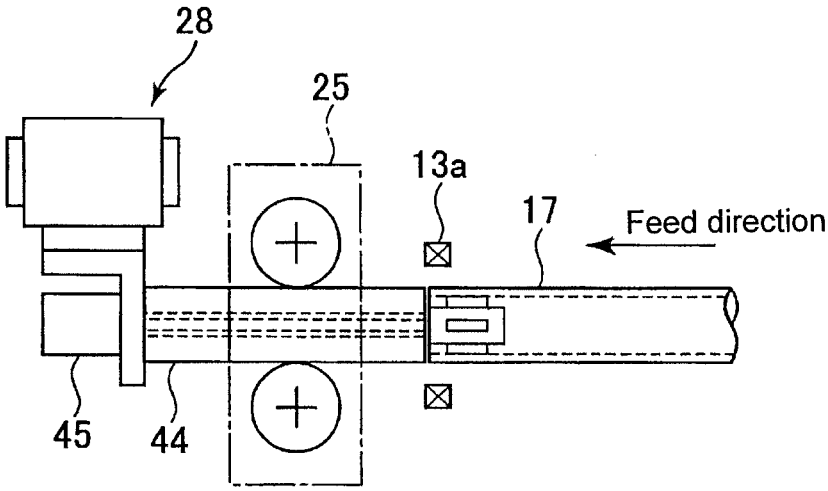
FIG. 6 is an explanatory view schematically showing one example of a chuck which is used in the third industrial robot in FIG. 1.

FIG. 6 is an explanatory view schematically showing an example of a chuck 44 used by the third industrial robot 28 in FIG. 1. Symbol 45 in FIG. 6 indicates a cylinder.

As shown in FIG. 6, when a steel tube 17 undergoes bending while being quench-hardened from the vicinity of its front end, the chuck 44 is preferably an elongated chuck having an outer diameter with dimensions roughly corresponding to the outer diameter of the steel tube 17.

Figure 7:
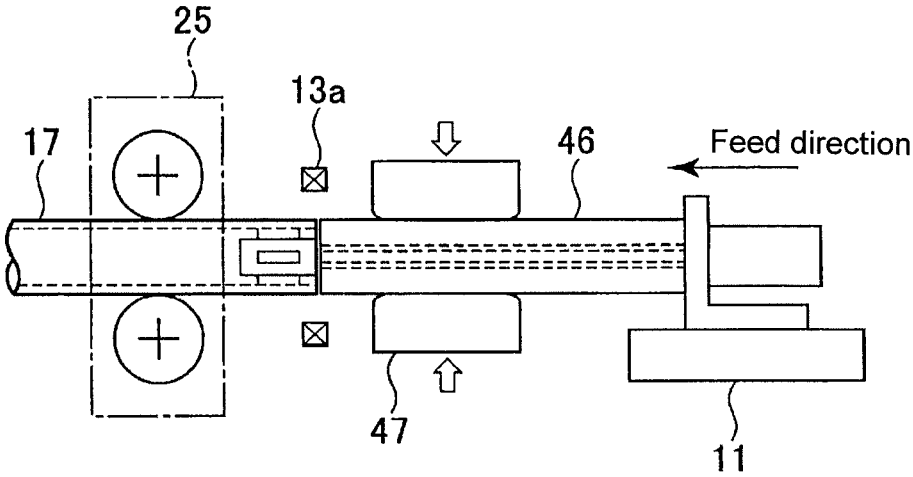
FIG. 7 is an explanatory view schematically showing an example of a chuck which is used in the feed device of FIG. 1.

FIG. 7 is an explanatory view schematically showing an example of a chuck 46 used in the feed mechanism in FIG. 1. Symbol 47 in FIG. 7 indicates a support guide.

Figure 8:
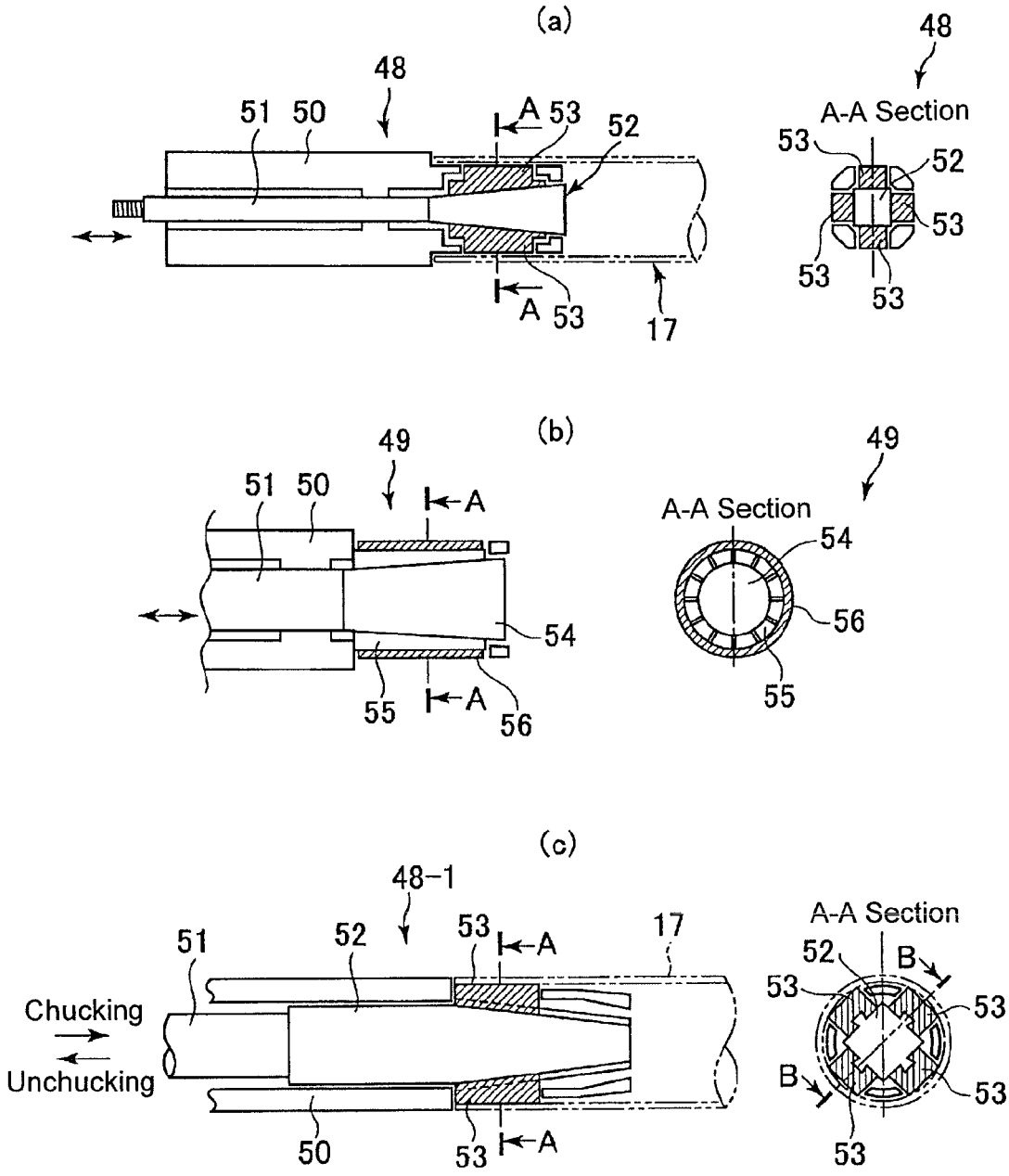
FIG. 8(*a*)-FIG. 8(*c*) are explanatory views schematically showing mechanisms for enlarging the outer dimensions of a chuck which grips an end of a steel tube by being inserted inside the steel tube and contacting the inner surface of the steel tube.

As shown in FIG. 7, when a steel tube 17 is being bent while being quench-hardened up to the vicinity of its rear end, it is preferable to use an elongated chuck 46 having an outer diameter with dimensions roughly corresponding to the outer diameter of the steel tube 17. FIGS. 8(*a*)-8(*c*) are explanatory views schematically showing mechanisms for enlarging the outer dimensions of chucks 48, 49, and 48-1 which grip an end of a steel tube 17 by being inserted into the steel tube 17 and contacting the inner surface of the steel tube 17.

Inside a cylindrical body 50, chuck 48 has a shaft 51 which can be advanced and retracted by an unillustrated cylinder or the like and an operating bar 52, for example, which is disposed at the front end of the shaft 51. Four chuck claws 53 are disposed at predetermined positions in the axial direction of the body 50 on the sloping surface of the operating bar 52. The chuck claws 53 are moved in the radial direction by movement of the shaft 51 in the axial direction of the body 50, thereby increasing or decreasing the outer dimensions of the chuck 48.

Inside a cylindrical body 50, chuck 49 has a shaft 51 which can be advanced and retracted by an unillustrated cylinder or the like and a conical bar 54, for example, which is disposed at the front end of the shaft 51. A large number of segments 55 and an elastic claw 56 are disposed on the sloping surface of the conical bar 54. When the shaft 51 is moved in the axial direction of the body 50, the segments 55 are moved in the radial direction, and as a result, the outer dimensions of the chuck 49 are increased or decreased.

Chuck 48-1 is a modification of chuck 48. The operating bar 52 has a tapered shape. The tapered operating bar 52 can increase the cross-sectional area of the joint with the shaft 51 and thereby increase the strength of the operating bar 52.

The chuck claws 53 preferably have dovetail grooves which extend in the axial direction of the body 50 to enable unclamping to be carried out with certainty.

Examples of the materials used for the chuck claws 53 and the operating bar 52 are austenitic stainless steel and tool steel. Austenitic stainless steel is suitable because it is non-magnetic and does not readily undergo inductive heating, but it is somewhat inferior with respect to wear resistance (resistance to damage) and antiseizure properties. On the other hand, tool steel has superior durability in a cold state. Tool steel is magnetic and is easily affected by inductive heating, but there are no problems in actual use unless the vicinity of the chuck claws 53 undergoes inductive heating. The body 50 is preferably a non-magnetic member made of austenitic stainless steel or the like.

Figure 9:
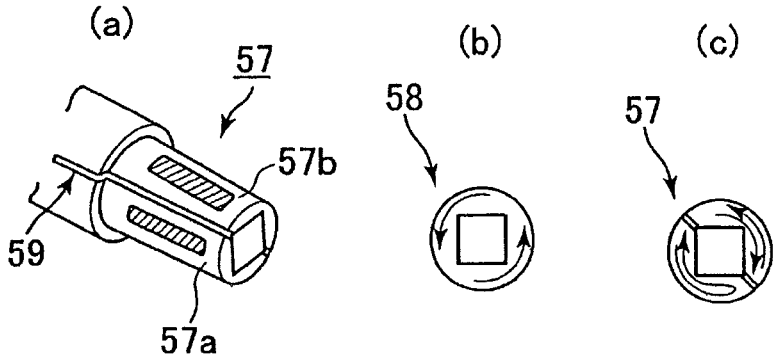
FIG. 9(*a*) is an explanatory view schematically showing an example of the structure of a chuck which is suitable for use in a bending apparatus according to the present invention, FIG. 9(*b*) shows a comparative example of a chuck, and FIG. 9(*c*) shows an example of a chuck according to the present invention.

FIG. 9(*a*) is an explanatory view schematically showing an example of the structure of a chuck 57 suitable for use in a bending apparatus 10 according to the present invention, FIG. 9(*b*) shows a chuck 58 as a comparative example, and FIG. 9(*c*) shows a chuck 57 as an example according to the present invention.

As shown in FIG. 9(*a*) and FIG. 9(*c*), chuck 57 has components 57*a* and 57*b* and insulating members 59. Components 57*a* and 57*b* are divided into a plurality of members (two in the illustrated example) in the circumferential direction. The insulating members 59 are disposed between two adjoining components 57*a* and 57*b*. The insulating members 59 are made of polytetrafluoroethylene or the like, for example.

As shown in FIG. 9(*c*), by disposing insulating members 59 between a plurality of components 57*a* and 57*b* of the chuck 57, currents flowing in the components 57*a* and 57*b* cancel each other. As a result, current induced by the high frequency heating coil 13*a* is prevented from flowing around the components 57*a* and 57*b* and heating the chuck 58.

Figure 10:
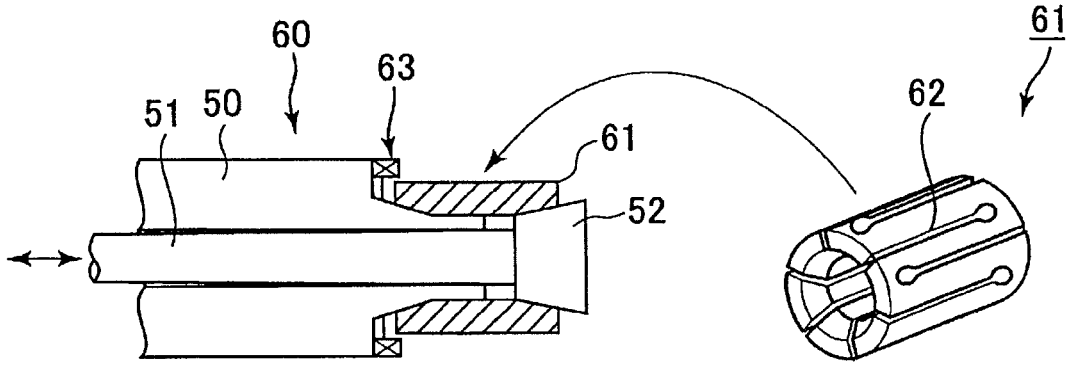
FIG. 10 is an explanatory view showing an example of the structure of a chuck of a type having a sleeve with slits which is suitable for use in a bending apparatus according to the present invention.

FIG. 10 is an explanatory view showing the structure of a chuck 60 of a sleeve type with slits which is suitable for use in a bending apparatus according to the present invention.

Chuck 60 has a shaft 51 which can be advanced and retracted by an unillustrated cylinder or the like and an operating bar 52, for example, disposed at the front end of the shaft 51, both of which are inside a cylindrical body 50 of the chuck 60. A sleeve 61 having slits 62 and a sealing ring 63 are disposed on the sloping surface of the operating bar 52 in predetermined positions in the axial direction of the body 50. The sleeve 61 with slits elastically deforms and increases or decreases in diameter when the shaft 51 moves in the axial direction of the body 50. As a result, the outer dimensions of the chuck 60 are increased or decreased.

Because the sleeve 61 has a plurality of slits 62, it can elastically deform under a small force and it is not readily heated by induction heating even when it is made of metal.

Inductive heating of the sleeve 61 can be adequately prevented simply by making the sleeve 61 from a non-magnetic member. The slits 62 are preferably provided when the strength of the sleeve 61 is adequately guaranteed.

Figure 11:
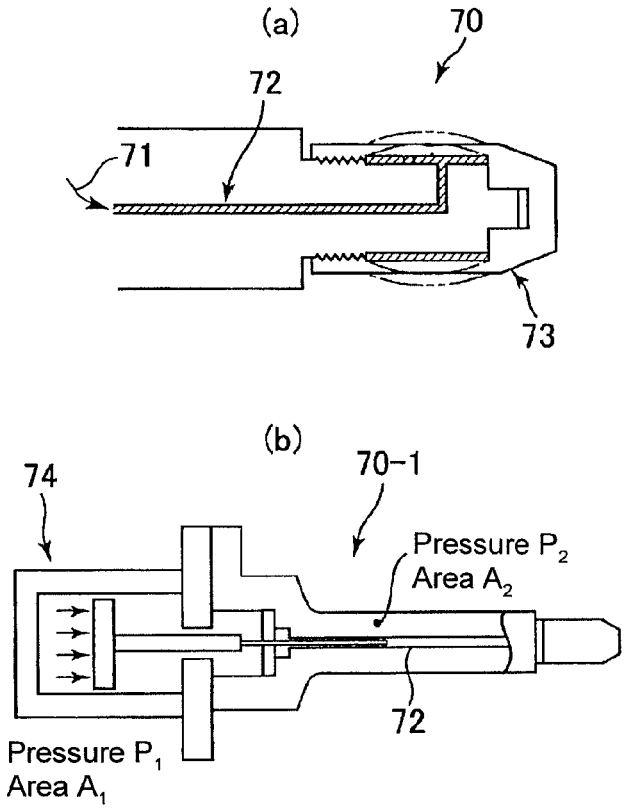
FIG. 11(*a*) is an explanatory view showing an example of the structure of a chuck of a type having a hydraulic sleeve which is suitable for use in a bending apparatus according to the present invention, and FIG. 11(*b*) is an explanatory view showing a modification thereof.

FIG. 11(*a*) is an explanatory view showing the structure of a chuck 70 with a hydraulic sleeve which is suitable for use in a bending apparatus according to the present invention, and FIG. 11(*b*) is an explanatory view of a modification 70-1 thereof.

A passage 72 for high pressure fluid 71 which was generated using an unillustrated high pressure pump is formed inside the chuck 70. A sleeve 73 which is formed from an elastic member is provided on the outer periphery of the tip of the body of the chuck 70. The sleeve 73 is deformed so as to expand by passing the high pressure fluid 71 through the passage 72. Chuck 70 can decrease the outer diameter of the tip of the body, so it can be used as a chuck having a small inner diameter. The sleeve 73 is preferably made of a heat-resistant metal. Chuck 70-1 has a cylinder 74 which produces a high pressure fluid 71. By making the cross-sectional area $A_1$ of the operating portion of the cylinder 74 larger than the cross-sectional area $A_2$ of a passage 72, the pressure $P_2$ in the passage 72 can be made high even when the operating pressure $P_1$ of the cylinder 74 is low.

Figure 12:
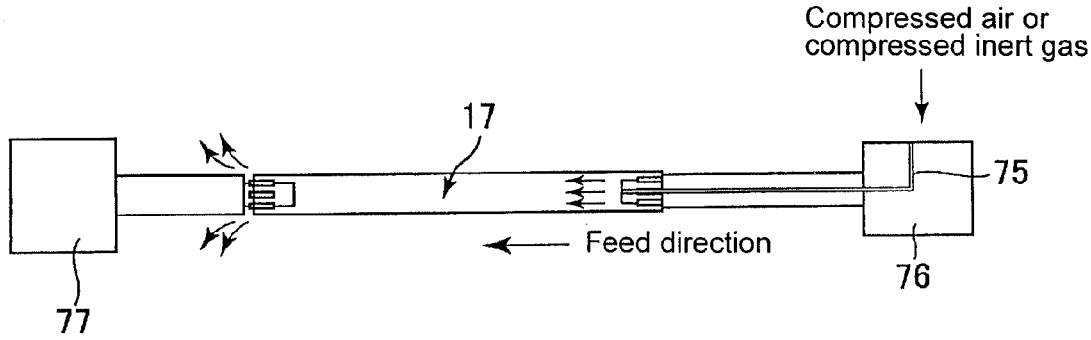
FIG. 12 is an explanatory view showing a mechanism for applying a positive pressure to the interior of a steel tube.
Figure 13:
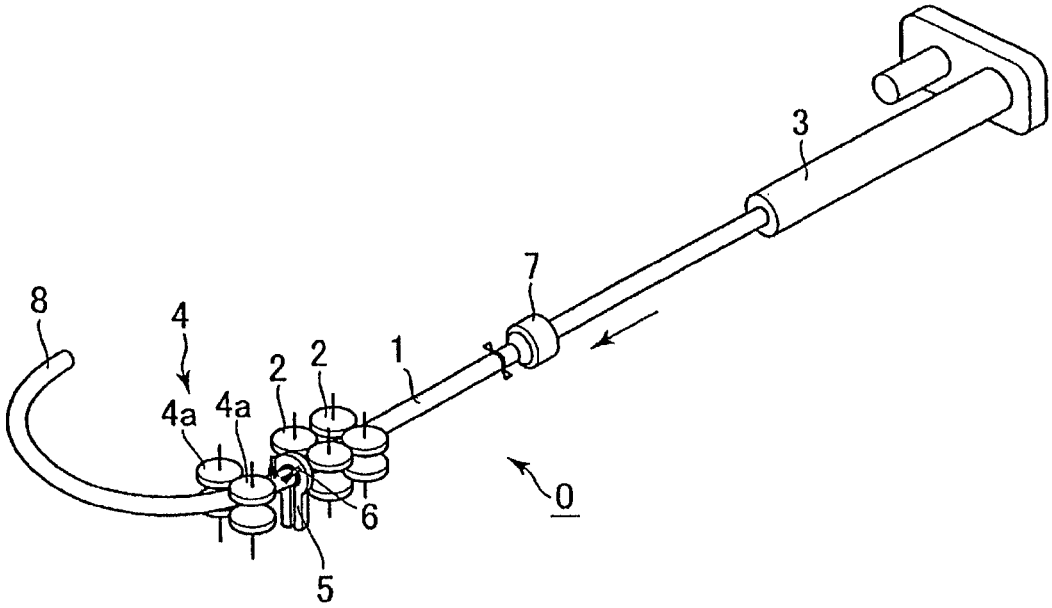
FIG. 13 is an explanatory view schematically showing the structure of a bending apparatus disclosed in Patent Document 1.

FIG. 12 is an explanatory view of a mechanism for producing a positive pressure inside a steel tube 17.

If a sealing member at the end of the steel tube 17 is made of a soft material such as rubber, the durability of the sealing member is sometimes inadequate. If the sealing member is made of metal, it is sometimes not possible to prevent entry of water into the steel tube 17.

Therefore, a feed side chuck 76 which has a passage 75 inside an operating bar for supplying compressed air or a compressed inert gas is used as a mechanism for producing a positive pressure inside a steel tube 17. The mechanism is preferably designed such that the compressed air or a compressed inert gas supplied to the interior of the steel tube 17 is discharged from an exit side chuck 77. As a result, a positive pressure is maintained inside the steel tube 17, and cooling water from the cooling device 14 can be completely prevented from entering inside the steel tube 17.

An inert gas such as nitrogen gas is preferably supplied to the interior of the steel tube 17 in order to suppress oxidation of the inside of the steel tube 17.

When the above-described chucks grip the inner surface of a material being working having a polygonal transverse cross section such as a rectangular cross section or when gripping of a material being processed having a shaped transverse cross-sectional shape with corners, the gripping force can be increased and the material being processed can be centered with certainty if gripping is performed such that the chuck contacts each of the corners of the inner peripheral surface of the material being processed.

The first industrial robot 18 moves steel tubes 17 from a pallet 23 to the bending apparatus 10 and sets them in the bending apparatus 10. As a result, a decrease in the cycle time and an increase in the productivity of the bending apparatus 10 can be achieved.

[First Support Mechanism 12]

The first support mechanism 12 is fixed at a first position A. The first support mechanism 12 supports a steel tube 17 while feeding it. In the same manner as in bending apparatus 0, the first support mechanism 12 comprises a die. The die has at least one pair of roll pairs 12*a*, 12*a* (in the illustrated example, it also has one more set of roll pairs 12*b*, 12*b* for a total of two sets) which can support a steel tube 17 while feeding it. Such a die is well known by those skilled in the art, so an explanation of the first support mechanism 12 will be omitted The first support mechanism 12 is constituted as described above.

[Heating Mechanism 13]

The heating mechanism 13 is disposed at a second position B downstream of the first position A in the feed direction of a steel tube 17 and is supported by a heating coil support robot 27. The heating mechanism 13 heats all or a portion of a steel tube 17 being fed.

An induction heating device having a heating coil 13*a* which is disposed around and separated from a steel tube 17 is used as the heating mechanism 13. A heating coil 13*a* is well known by those skilled in the art, so an explanation of the heating mechanism 13 will be omitted.

[Cooling Mechanism 14]

The cooling mechanism 14 is fixed at a third position C downstream of the second position B in the feed direction of a steel tube 17. The cooling mechanism 14 forms a high temperature portion in a portion of the steel tube 17 by cooling the portion of the steel tube 17 being fed which was heated by the heating mechanism 13.

The cooling mechanism 14 uses a water cooling device, for example. The water cooling device has cooling water spraying nozzles 14*a* and 14*b* spaced from the outer surface of the steel tube 17. Such cooling water spraying nozzles 14*a* and 14*b* are well known by those skilled in the art, so an explanation of the cooling mechanism 14 will be omitted.

[Second Support Mechanism 15]

The second support mechanism 15 is disposed at a fourth position D downstream of the third position C in the feed direction of a steel tube 17. The second support mechanism 15 imparts a bending moment to the high temperature portion of the steel tube 17 between positions B and C (a portion which was heated and greatly decreased in resistance to deformation) and bends the steel tube 17 into a desired shape by moving two or three-dimensionally while supporting at least one location on the steel tube 17 being fed.

In the same manner as in bending apparatus 0, the second support mechanism 15 is constituted by a movable roller die 25. The movable roller die 25 has at least one set of roll pairs 25*a* and 25*b* which can support a steel tube 17 while feeding it. However, as a different arrangement, an end effector such as a gripper which is held by the second industrial robot 26 may be used as the second support mechanism 15, and the steel tube 17 may be directly gripped by the end effector.

The movable roller die 25 is supported by the second industrial robot 26. Like the above-described first industrial robot 18, the second industrial robot 26 is a so-called vertical articulated robot. It has first through sixth axes and if necessary a seventh axis. The first through seventh axes are driven by AC servomotors.

The gripper 26*a* is provided at the end of the wrist 20*a* of the second industrial robot 26 as an end effector which holds the movable roller die 25. However, the end effector need not be a gripper 26*a*.

[Malformation n Preventing Mechanism 16]

The malformation n preventing mechanism 16 is disposed at a fifth position E downstream of the fourth position D in the feed direction of a steel tube 17. The malformation preventing mechanism 16 prevents malformation of a steel tube 17 being fed.

A third industrial robot 28 is used as the malformation preventing mechanism 16.

Like the above-described first industrial robot 18 and second industrial robot 27, the third industrial robot 28 is a so-called vertical articulated robot. It has first through sixth axes and if necessary a seventh axis. The first through seventh axes are driven by AC servomotors.

Any of the chucks explained while referring to FIGS. 3-11 is provided on the end of the wrist 20*a* of the third industrial robot 28 and is used as an end effector for holding an end 17*a* of a steel tube 17.

The bending apparatus 10 preferably carries out bending in a warm or hot state. A warm state means a heating temperature range in which the resistance to deformation of a metal material is lower than at room temperature. For example, with some metal materials, it is a temperature range of around 500-800° C. A hot state means a heating temperature range at which the resistance to deformation of a metal material is lower than at room temperature and which is necessary for the metal material to be quench hardened. For example, for some steel materials, it is a temperature range of 870° C. or higher. In particular, when bending is carried out in a hot state, after a predetermined temperature for quench hardening is reached, quenching can be carried out by cooling at a predetermined cooling speed. When bending is carried out in a warm state, the occurrence of strains during working such as thermal strains can be prevented by cooling the bent portion.

The bending apparatus 10 has the structure described above.

Because at least one of the feed mechanism 11 and the deformation preventing mechanism 16 has a tubular chuck which can grip a steel tube 17, the below-described effects are obtained.

(a) The feed mechanism 11 can properly hold the front end or the rear end of a steel tube 17, and bending can be carried out with sufficient accuracy.

(b) The feed mechanism 11 can prevent oxidation of the interior of a steel tube 17 which is exposed to the atmosphere at a high temperature.

(c) The force required for bending does not become too large, and the yield of a steel tube 17 which has been bent is high.

(d) Water is prevented from entering inside a steel tube 17, and heating of the steel tube by the high frequency heating coil 13*a* can be carried out as desired, so the bending accuracy is adequately increased.

(e) A steel tube 17 which is being bent can successively pass through the support mechanism 12, the high frequency heating coil 13*a*, and the water cooling mechanism 14, and bending can be carried out with certainty.

(f) The chuck which grips a steel tube 17 is prevented from undergoing inductive heating by the high frequency heating coil 13*a*, and it can hold the steel tube 17 continuously with certainty from the start to the finish of bending. As a result, the bending accuracy can be sufficiently increased.

The invention claimed is:

1. A bending apparatus for bending a hollow metal material while the hollow metal material is being fed in a feed direction of the hollow metal material, characterized by having:

a first support mechanism disposed at a first position in said feed direction, a heating mechanism disposed at a second position downstream of the first position in said feed direction, a cooling mechanism disposed at a third position downstream of the second position in said feed direction, and a second support mechanism disposed at a fourth position downstream of the third position in said feed direction, further characterized in that the first support mechanism supports the hollow metal material while feeding it through the bending apparatus, the heating mechanism heats all or a portion of the metal material being fed when the metal material passes the heating mechanism after passing through the first support mechanism, the cooling mechanism forms a high strength portion in part of the metal material by cooling the portion of the metal material being fed which was heated by the heating mechanism, the second support mechanism imparts a bending moment to the high temperature portion and bends the metal material into a desired shape by moving two-dimensionally or three-dimensionally while supporting at least one location of the metal material being fed, the second support mechanism comprises a second chuck, the second chuck further comprising a tubular member having a circular, polygonal, or special transverse cross section and which grips the metal material.

2. A bending apparatus as set forth in claim 1, further having a feed mechanism which feeds the metal material in its lengthwise direction.

3. A bending apparatus as set forth in claim 2 wherein the feed mechanism has a first chuck.

4. A bending apparatus as set forth in claim 1, wherein the first support mechanism feeds the metal material in its lengthwise direction.

5. The bending apparatus as set forth in claim 1, wherein the second chuck is inserted into the metal material and contacts the inner surface of the metal material.

6. A bending apparatus as set forth in claim 1 wherein the outer dimensions of the tubular member can be expanded.

7. The bending apparatus as set forth in claim 1, wherein the second chuck is disposed on the exterior of the metal material and contacts the outer surface of the metal material.

8. A bending apparatus as set forth in claim 1 wherein the inner dimensions of the tubular member can be reduced.

9. A bending apparatus as set forth in claim 1, wherein the second chuck seals the interior of the metal material.

10. A bending apparatus as set forth in claim 1, wherein the second chuck applies a positive pressure to the interior of the metal material.

11. A bending apparatus as set forth in claim 1, wherein the tubular member is disposed so that its central axis approximately coincides with the central axis of the metal material.

12. A bending apparatus as set forth in claim 1, wherein the tubular member has outer dimensions which roughly correspond to the outer dimensions of the metal material.

13. A bending apparatus as set forth in claim 1, wherein the tubular member has chuck claws and an operating bar made from a high hardness material.

14. A bending apparatus as set forth in claim 1, wherein the tubular member has a plurality of components which are divided in the circumferential direction and insulating members which are disposed between adjoining components.

15. A bending apparatus as set forth in claim 1, wherein the tubular member is non-magnetic.

16. A bending apparatus as set forth in claim 1, wherein the tubular member has a laminated structure.

17. The bending apparatus as set forth in claim 1, further comprising a feeding mechanism in which an end of the metal material is gripped with a first chuck, the feeding mechanism being disposed upstream of the first supporting mechanism, and the first chuck applying a positive pressure to the interior of the metal material.

18. A bending apparatus for bending a hollow metal material while the hollow metal material is being fed in a feed direction of the hollow metal material, characterized by having a first support mechanism disposed at a first position in said feed direction, a heating mechanism disposed at a second position downstream of the first position in said feed direction, a cooling mechanism disposed at a third position downstream of the second position in said feed direction, a second support mechanism disposed at a fourth position downstream of the third position in said feed direction, and a malformation preventing mechanism disposed at a fifth position downstream of the fourth position in said feed direction, and further characterized in that the first support mechanism supports the hollow metal material while feeding it through the bending apparatus, the heating mechanism heats all or a portion of the metal material being fed when the metal material passes the heating mechanism after passing through the first support mechanism, the cooling mechanism forms a high strength portion in part of the metal material by cooling the portion of the metal material being fed which was heated by the heating mechanism, the second support mechanism imparts a bending moment to the high temperature portion and bends the metal material into a desired shape by moving two-dimensionally or three-dimensionally while supporting at least one location of the metal material being fed, the malformation preventing mechanism prevents malformation of the metal material being fed, the malformation preventing mechanism comprises a third chuck, and the third chuck comprises a tubular member having a circular, polygonal, or special transverse cross section and which grips the metal material.

19. The bending apparatus as set forth in claim 18, further having a feed mechanism which feeds the metal material in its lengthwise direction.

20. The bending apparatus as set forth in claim 19, wherein the feed mechanism has a first chuck.

21. The bending apparatus as set forth in claim 18, wherein the first support mechanism feeds the metal material in its lengthwise direction.

22. The bending apparatus as set forth in claim 18, wherein the third chuck is inserted into the metal material and contacts the inner surface of the metal material.

23. The bending apparatus as set forth in claim 18, wherein the outer dimensions of the tubular member can be expanded.

24. The bending apparatus as set forth in claim 18, wherein the third chuck is disposed on the exterior of the metal material and contacts the outer surface of the metal material.

25. The bending apparatus as set forth in claim 18, wherein the inner dimensions of the tubular member can be reduced.

26. The bending apparatus as set forth in claim 18, wherein the third chuck seals the interior of the metal material.

27. The bending apparatus as set forth in claim 18, wherein the third chuck applies a positive pressure to the interior of the metal material.

28. The bending apparatus as set forth in claim 18, wherein the tubular member is disposed so that its central axis approximately coincides with the central axis of the metal material.

29. The bending apparatus as set forth in claim 18, wherein the tubular member has outer dimensions which roughly correspond to the outer dimensions of the metal material.

30. The bending apparatus as set forth in claim 18, wherein the tubular member has chuck claws and an operating bar made from a high hardness material.

31. The bending apparatus as set forth in claim 18, wherein the tubular member has a plurality of components which are divided in the circumferential direction and insulating members which are disposed between adjoining components.

32. The bending apparatus as set forth in claim 18, wherein the tubular member is non-magnetic.

33. The bending apparatus as set forth in claim 18, wherein the tubular member has a laminated structure.

34. The bending apparatus as set forth in claim 18, further comprising a feeding mechanism in which an end of the metal material is gripped with a first chuck, the feeding mechanism being disposed upstream of the first supporting mechanism, and the first chuck applying a positive pressure to the interior of the metal material.

* * * * *